US009138875B2

(12) United States Patent
Chen

(10) Patent No.: US 9,138,875 B2
(45) Date of Patent: Sep. 22, 2015

(54) RATCHET TOOL DEVICE

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 288 days.

(21) Appl. No.: 13/868,998

(22) Filed: Apr. 23, 2013

(65) Prior Publication Data

US 2014/0311300 A1 Oct. 23, 2014

(51) Int. Cl.
*B25B 13/46* (2006.01)

(52) U.S. Cl.
CPC ..... *B25B 13/463* (2013.01)

(58) Field of Classification Search
CPC ..... B25B 13/46; B25B 13/463; B25B 13/498
USPC ..... 81/62–63.2
See application file for complete search history.

(56) References Cited

U.S. PATENT DOCUMENTS

| | | | | |
|---|---|---|---|---|
| 7,328,633 | B2 * | 2/2008 | Lin | 81/63.1 |
| 7,802,498 | B2 * | 9/2010 | Hu | 81/63.1 |
| 7,827,886 | B2 * | 11/2010 | Hu | 81/63.1 |
| 7,975,574 | B2 * | 7/2011 | Hu | 81/63.1 |
| D688,107 | S * | 8/2013 | Liu | D8/25 |
| 2011/0048178 | A1 * | 3/2011 | Hu | 81/62 |
| 2011/0048179 | A1 * | 3/2011 | Hu | 81/63.1 |
| 2013/0145906 | A1 * | 6/2013 | Hu | 81/62 |

* cited by examiner

*Primary Examiner* — Hadi Shakeri

(57) ABSTRACT

A ratchet tool device includes a wrench body, a receiving hole and a receiving space opened at a top end of the wrench body, the receiving space axially opened from an inner wall of the receiving hole toward a bottom end of the wrench body, the receiving space communicating with the receiving hole, a ratchet wheel received in the receiving hole, a pawl set having a first pawl, a second pawl and an abutting elastomer, a switching set having a switching member and a positioning member, the switching member assembled to the wrench body and sealing the receiving space, the switching member having a driving block, the first pawl and the second pawl both assembled to the driving block.

7 Claims, 10 Drawing Sheets

RATCHET TOOL DEVICE

BACKGROUND OF THE INVENTION

1. Field of the Invention

The present invention relates to a tool device, and more particularly to a ratchet tool device.

2. Description of Related Art

A conventional ratchet wrench comprises a holding portion having a top end and a bottom end; a neck portion which has a cavity and is located at the top end of the holding portion, the cavity having a first recess located at its bottom and an opening located at its top, the first recess being filled by a compressible elastic member and a ball in sequence, the opening being inserted and tightly fit with a bendable elastic member; a driving block installed inside the cavity, the driving block having a second recess at its top for holding a bottom of the bendable elastic member, the driving block having two nearby arc grooves at its bottom; a controlling rod which extends to a surface of the neck portion and links the driving block to shift the driving block in the cavity, thus allowing the ball to be pressed into one of the arc grooves by the compressible elastic member, whereby, the driving block is fixed at a predetermined angle by the ball and thus the bendable elastic member is bent toward one side of the holding portion; a shifting lever located above the cavity, the shifting lever having a cave to engage with a top of the bendable elastic member and being pressed by the bendable elastic member to rotate itself, the shifting lever having an arc shaped concave surface at its top and a first teeth structure disposed at the arc shaped concave surface; and a gear wheel located above the shifting lever, the gear wheel having a space to install a ratchet, the ratchet having a second teeth structure disposed at its surface to correspond the first teeth structure. Wherein, the shifting lever is rotated and fixed when the bendable elastic member is bent, and thus the first teeth structure meshes one side of the second teeth structure to control an operating direction of the gear wheel.

However, the conventional ratchet wrench has one shortcoming as following:

The shifting lever is not directly driven by the driving block, but indirectly driven by the driving block via the bendable elastic member. Therefore, the operation structure is not stable because the shifting lever is not directly driven by the driving block.

The present invention has arisen to mitigate and/or obviate the disadvantages of the conventional.

SUMMARY OF THE INVENTION

The main objective of the present invention is to provide an improved tool device.

To achieve the objective, a ratchet tool device comprises a wrench body, a receiving hole opened at a top end of the wrench body therethrough, a receiving space defined at the top end of the wrench body, the receiving space axially opened from an inner wall of the receiving hole toward a bottom end of the wrench body, the receiving space communicating with the receiving hole; a ratchet wheel received in the receiving hole; a pawl set having a first pawl, a second pawl and an abutting elastomer, the first pawl and the second pawl both received in the receiving space, the abutting elastomer assembled between the first pawl and the second pawl, one end of the abutting elastomer abutting against one side of the first pawl, another end of the abutting elastomer abutting against one side of the second pawl; and a switching set having a switching member and a positioning member, the switching member assembled to the wrench body and sealing the receiving space, the switching member having a driving block and a positioning space, the first pawl and the second pawl in the receiving space both assembled to the driving block. Wherein, the driving block has a supporter extended therefrom in the receiving space; the first pawl and the second pawl are both placed on the supporter; the driving block has a sliding groove defined thereon; each of the first pawl and the second pawl has a rod; the rod of each of the first pawl and the second pawl is extended into the sliding groove, so that the first pawl and the second pawl are slidable along the sliding groove on the driving block; the positioning space has a first positioning hole, a second positioning hole and a third positioning hole which are communicating with each other; the wrench body has an abutting hole; the positioning member has a switching elastomer and a bead; two ends of the switching elastomer respectively abut against a bottom of the abutting hole and the bead; the bead is received into the positioning space; the bead is movable relative to the positioning space, so that the bead is selectively moved to one of the first positioning hole, the second positioning hole and the third positioning hole; the switching member has a through hole opened thereon; the switching member is mounted around one end of the ratchet wheel via the through hole; the switching member has a step portion defined at an outer side thereof; a surface of the step portion is rough.

Under this arrangement, one end of the positioning member abuts against the wrench body; another end of the positioning member abuts against the positioning space; the positioning member is movable relative to the positioning space, so as to selectively engage the first pawl or the second pawl with the ratchet wheel, or disengage the first pawl or the second pawl from the ratchet wheel.

A ratchet tool device comprises a wrench body having a receiving hole which is opened at a top end of the wrench body therethrough, a receiving space defined at the top end of the wrench body, the receiving space axially opened from an inner wall of the receiving hole toward a bottom end of the wrench body, the receiving space communicating with the receiving hole, the receiving space having a first positioning groove and a second positioning groove both defined at a bottom thereof; a ratchet wheel received in the receiving hole; a pawl set having a first pawl, a second pawl and an abutting elastomer, the first pawl and the second pawl both received in the receiving space, the abutting elastomer assembled between the first pawl and the second pawl, one end of the abutting elastomer abutting against one side of the first pawl, another end of the abutting elastomer abutting against one side of the second pawl; a switching set having a switching member, the switching member sealing the receiving space, the switching member having a driving block, the first pawl and the second pawl in the receiving space both assembled to the driving block, the driving block having an abutting hole opened at a bottom side thereof; and a positioning member having two ends, one end of the positioning member abutting against a bottom of the abutting hole, another end of the positioning member abutting against the first positioning groove or the second positioning groove. Wherein, the positioning member has a switching elastomer and a bead; two ends of the switching elastomer respectively abut against a bottom of the abutting hole and the bead; the bead is movable relative to the receiving space, so as to be selectively positioned at one of the first positioning groove and the second positioning groove; the driving block has a sliding groove defined thereon; the sliding groove is curve-shaped, and has a concave side and a convex side; the concave side of the sliding groove faces the receiving hole; the convex side of the sliding groove faces the receiving space; each of the first pawl and the second pawl has a rod defined at one side thereof; the rod of each of the first pawl and the second pawl is extended into the sliding groove, so that the first pawl and the second pawl are slidable along the sliding groove on the driving block; the receiving space has two top abutting walls and two bottom abutting walls; the driving block selectively abuts against one of the two bottom abutting walls; the first pawl or the second pawl selectively abuts against one of the two top abutting walls.

Under this arrangement, the switching set is operable, so as to engage the first pawl or the second pawl with the ratchet wheel, or disengage the first pawl or the second pawl from the ratchet wheel.

Further benefits and advantages of the present invention will become apparent after a careful reading of the detailed description with appropriate reference to the accompanying drawings.

DETAILED DESCRIPTION OF THE INVENTION

Figure 1:
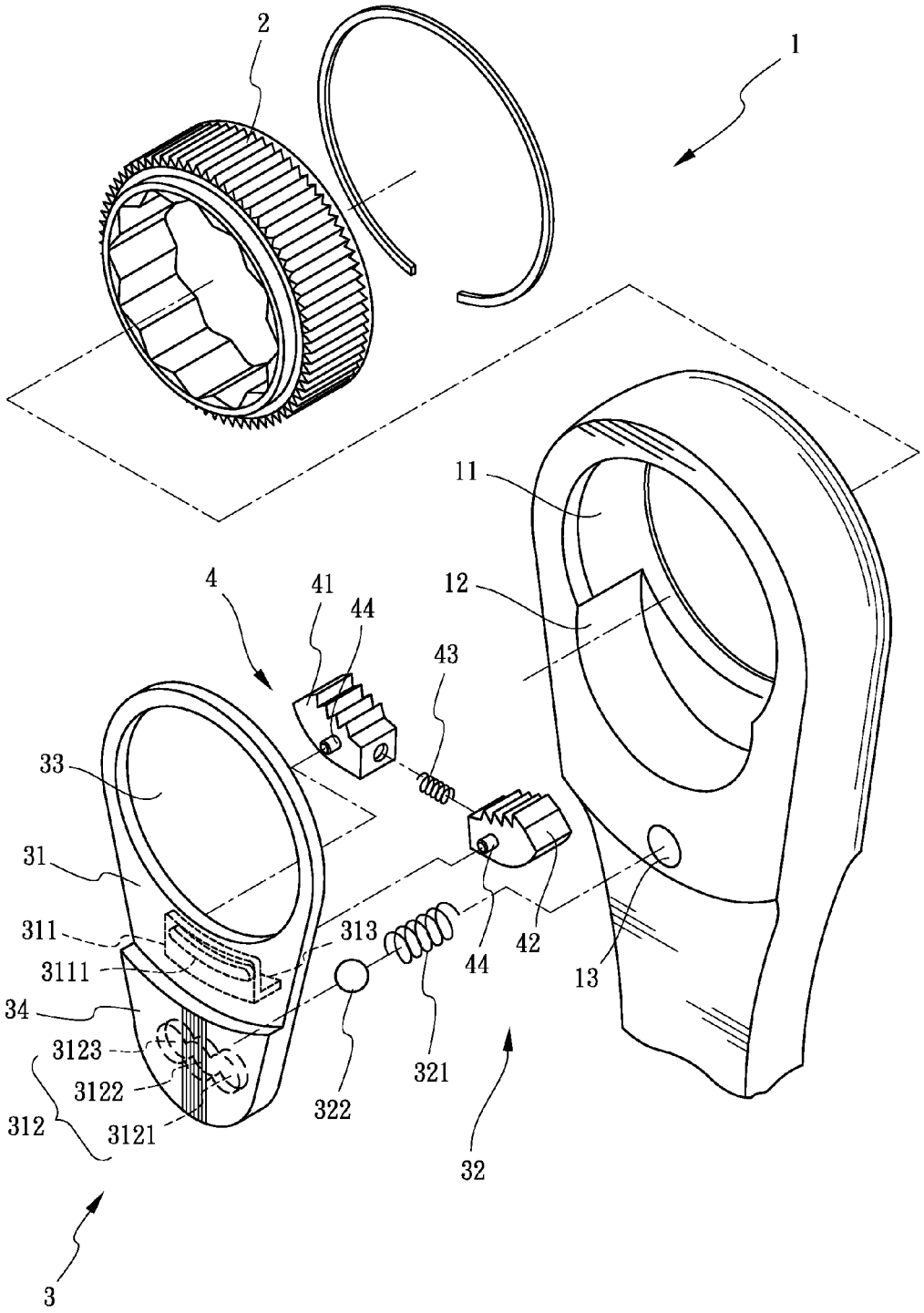
FIG. 1 is an exploded view of a first embodiment of the present invention.
Figure 2:
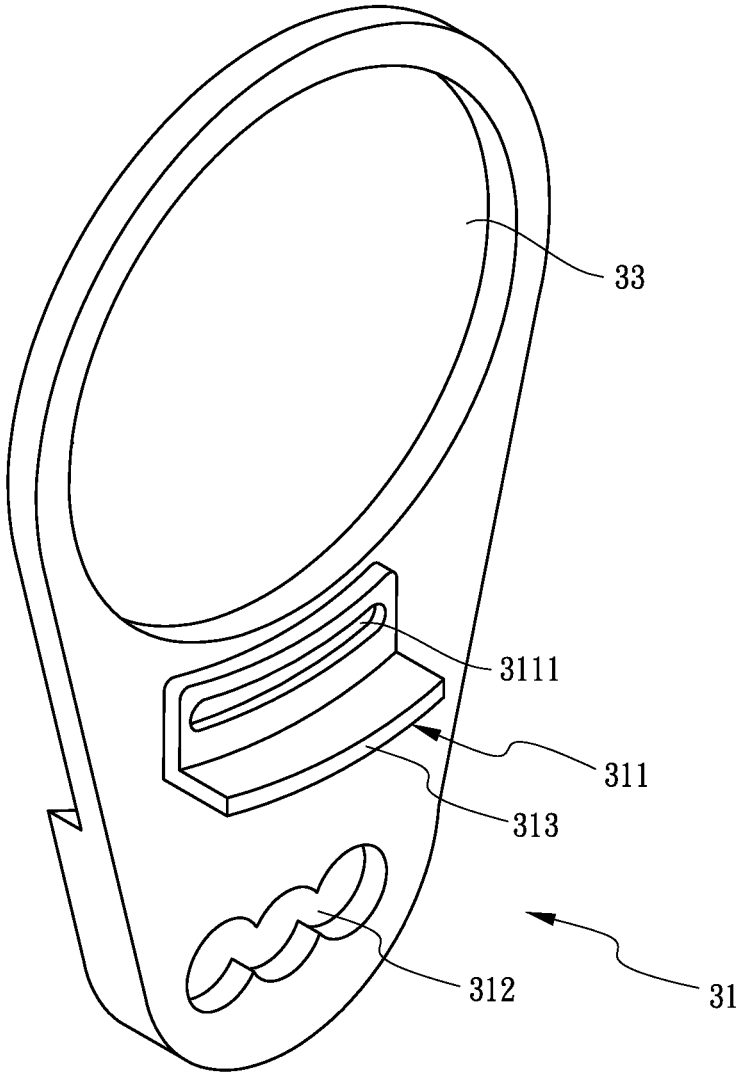
FIG. 2 is a perspective view of a switching member of the first embodiment.
Figure 3:
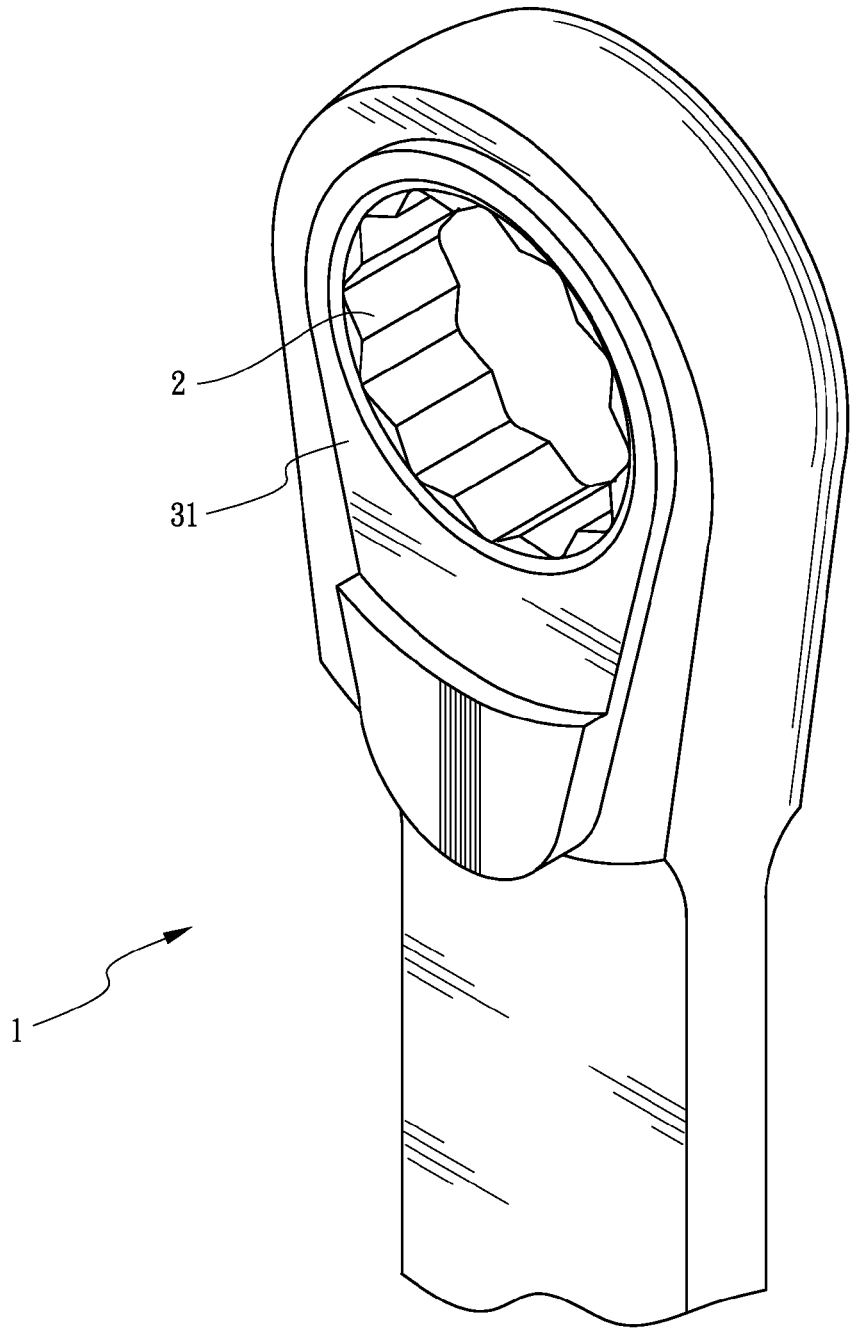
FIG. 3 is an assembled view of the first embodiment.

Referring to FIGS. 1-6, a first embodiment of the present invention is described as following. A ratchet tool device in accordance with the present invention comprises a wrench body 1, a ratchet wheel 2, a switching set 3 and a pawl set 4. A receiving hole 11 is opened at a top end of the wrench body 1 therethrough. A receiving space 12 is defined at the top end of the wrench body 1. The receiving space 12 is axially opened from an inner wall of the receiving hole 11 toward a bottom end of the wrench body 1. The receiving space 12 communicates with the receiving hole 11. The ratchet wheel 2 is received in the receiving hole 11. The pawl set 4 has a first pawl 41, a second pawl 42 and an abutting elastomer 43. The first pawl 41 and the second pawl 42 are both received in the receiving space 12. The abutting elastomer 43 is assembled between the first pawl 41 and the second pawl 42. One end of the abutting elastomer 43 abuts against one side of the first pawl 41. Another end of the abutting elastomer 43 abuts against one side of the second pawl 42. The switching set 3 has a switching member 31 and a positioning member 32. The switching member 31 is assembled to the wrench body 1 and seals the receiving space 12. The switching member 31 has a driving block 311 and a positioning space 312. The first pawl 41 and the second pawl 42 in the receiving space 12 are both assembled to the driving block 311, so as to be engaged with the ratchet wheel 2. One end of the positioning member 32 abuts against the wrench body 1; another end of the positioning member 32 abuts against the positioning space 312. The positioning member 32 is movable relative to the positioning space 312, so as to selectively engage the first pawl 41 or the second pawl 42 with the ratchet wheel 2, or disengage the first pawl 41 or the second pawl 42 from the ratchet wheel 2.

The driving block 311 has a sliding groove 3111 defined thereon. The sliding groove 3111 is curve-shaped, and has a concave side and a convex side. The concave side of the sliding groove 3111 faces the receiving hole 11. The convex side of the sliding groove 3111 faces the receiving space 12. Each of the first pawl 41 and the second pawl 42 has a rod 44 defined at one side thereof. The rod 44 of each of the first pawl 41 and the second pawl 42 is extended into the sliding groove 3111, so that the first pawl 41 and the second pawl 42 are slidable along the sliding groove 3111 on the driving block 311.

The positioning space 312 has a first positioning hole 3121, a second positioning hole 3122 and a third positioning hole 3123. The first positioning hole 3121, the second positioning hole 3122 and the third positioning hole 3123 communicate with each other. The wrench body 1 has an abutting hole 13. The positioning member 32 has a switching elastomer 321 and a bead 322. Two ends of the switching elastomer 321 respectively abut against a bottom of the abutting hole 13 and the bead 322. The bead 322 is partially received in the positioning space 312 so as to be positioned. The bead 322 is movable relative to the positioning space 312, so that the bead 322 is selectively positioned at one of the first positioning hole 3121, the second positioning hole 3122 and the third positioning hole 3123. The switching member 31 is operable to have the positioning member 32 move relative to the positioning space 312.

Figure 4:
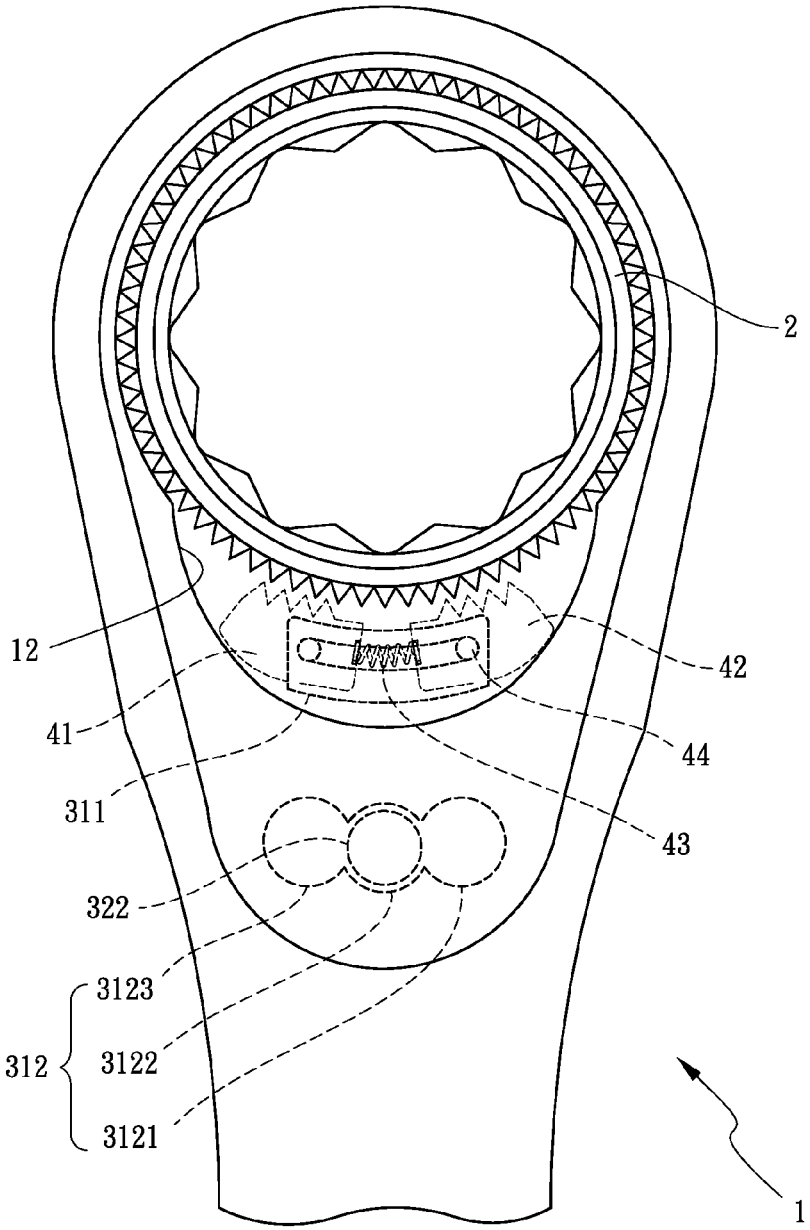
FIGS. 4-6 are side views for showing an operation of the first embodiment.

Referring to FIG. 4, when the positioning member 32 is positioned at the second positioning hole 3122 of the positioning space 312, the first pawl 41 and the second pawl 42 are both disengaged from the ratchet wheel 2, so that the ratchet wheel 2 is clockwise and counterclockwise rotatable relative to the wrench body 1.

Figure 5:
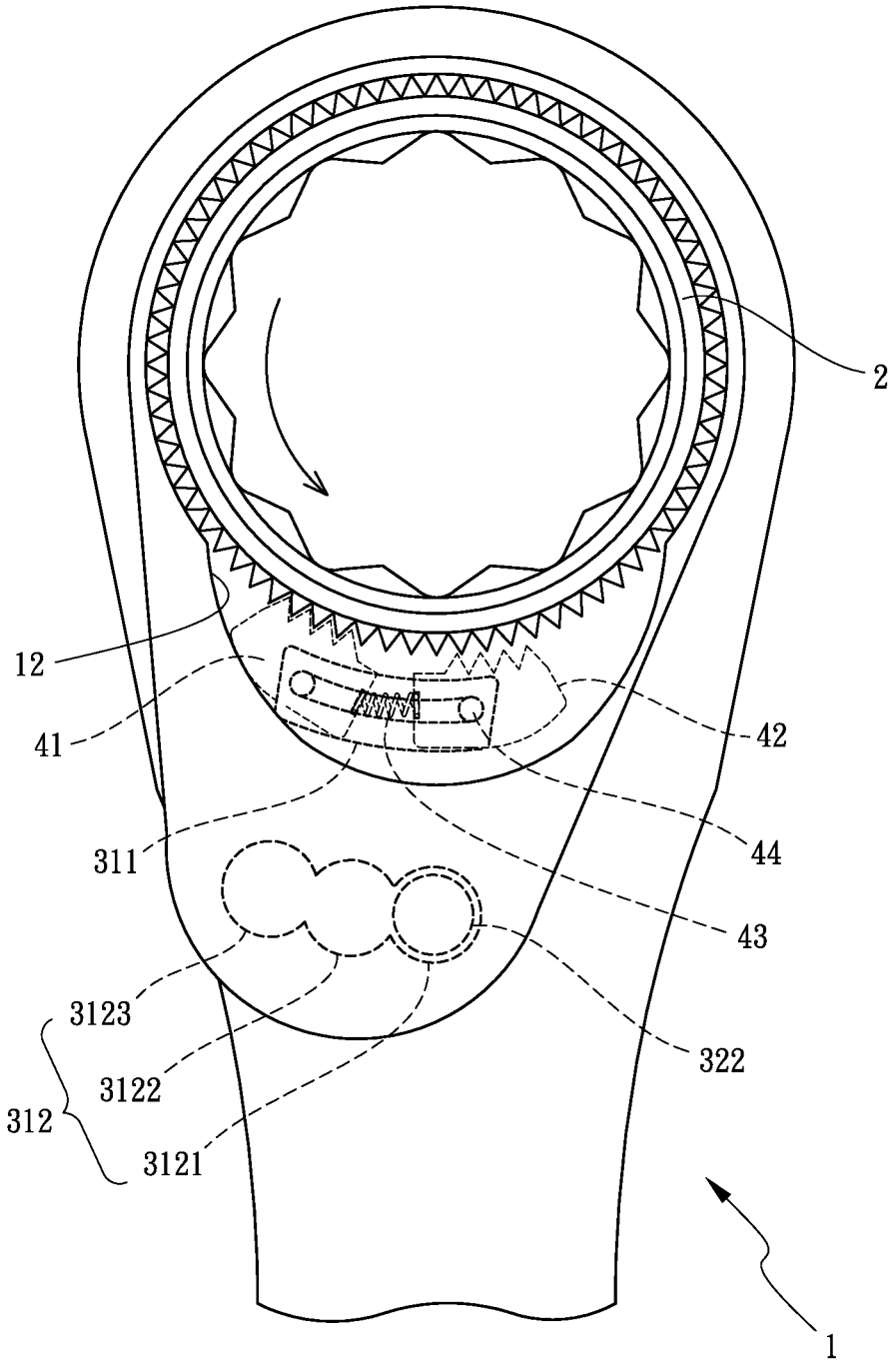

Referring to FIG. 5, when the switching member 31 is clockwise rotated, the positioning member 32 is moved relative to the positioning space 312 and is positioned at the first positioning hole 3121; the pawl set 4 is clockwise moved by the motion of the driving block 311 of the switching member 31; as a result, the first pawl 41 is engaged with the ratchet wheel 2 and is abutted against a left inner wall of the receiving space 12, and the second pawl 42 is disengaged from the ratchet wheel 2. Under this arrangement, the ratchet wheel 2 is not clockwise rotatable relative to the wrench body 1, but counterclockwise rotatable relative to the wrench body 1; when the ratchet wheel 2 is counterclockwise rotated relative to the wrench body 1, the first pawl 41 is moved toward the abutting elastomer 43 by the pushing from the ratchet wheel 2; as a result, the first pawl 41 is disengaged from the ratchet wheel 2 step by step by a recovery force of the abutting elastomer 43.

Figure 6:
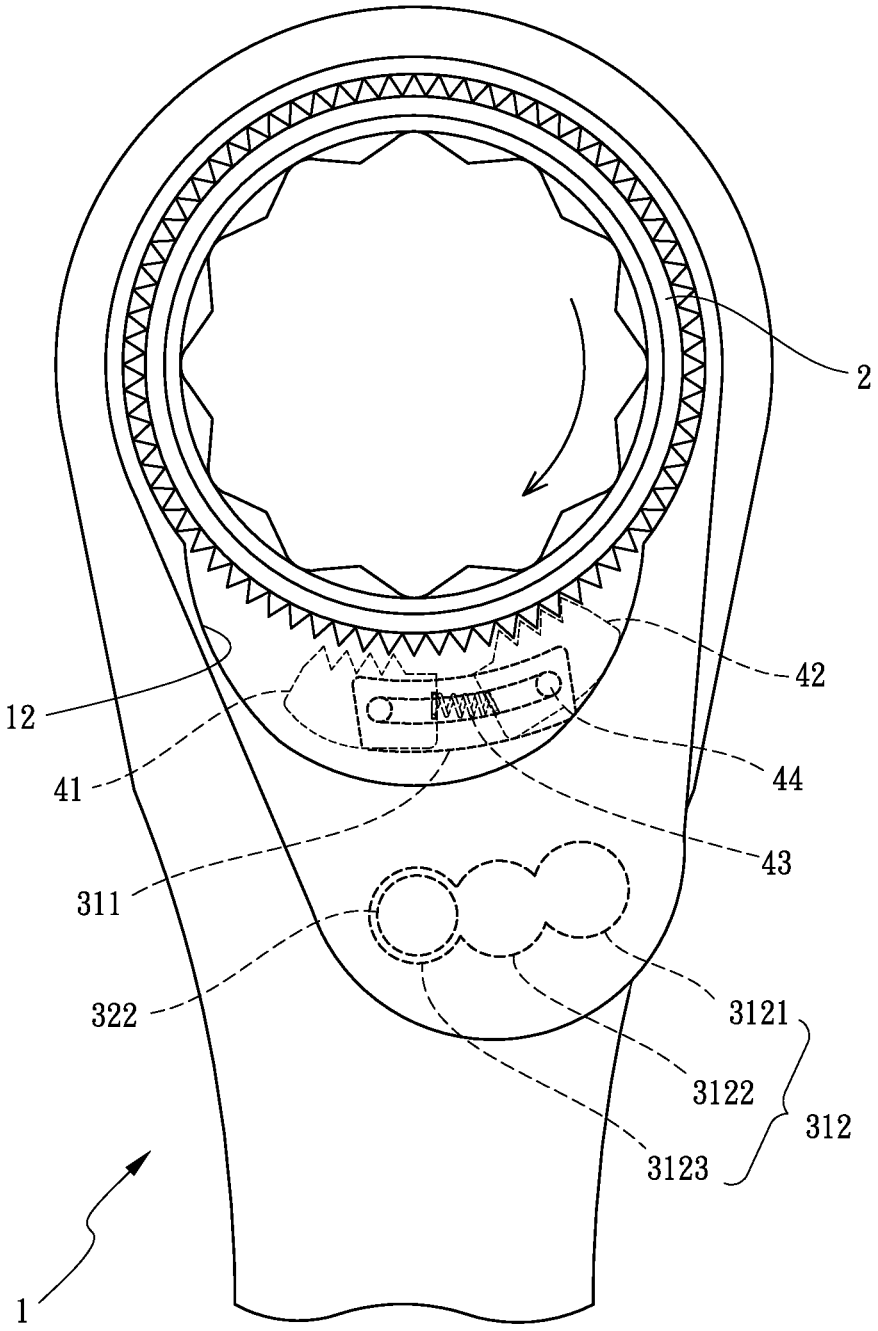
Figure 7:
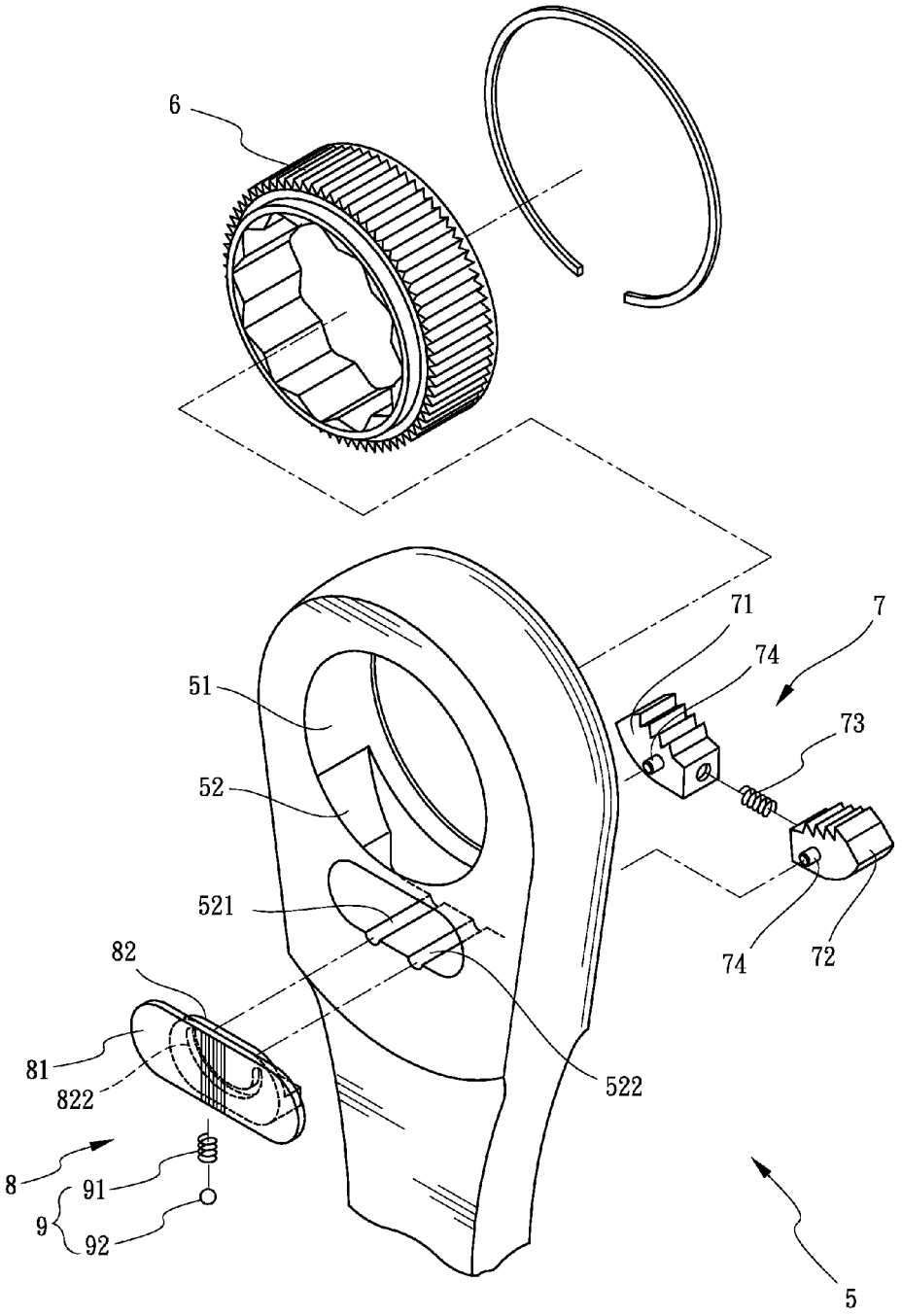
FIG. 7 is an exploded view of a second embodiment of the present invention.
Figure 8:
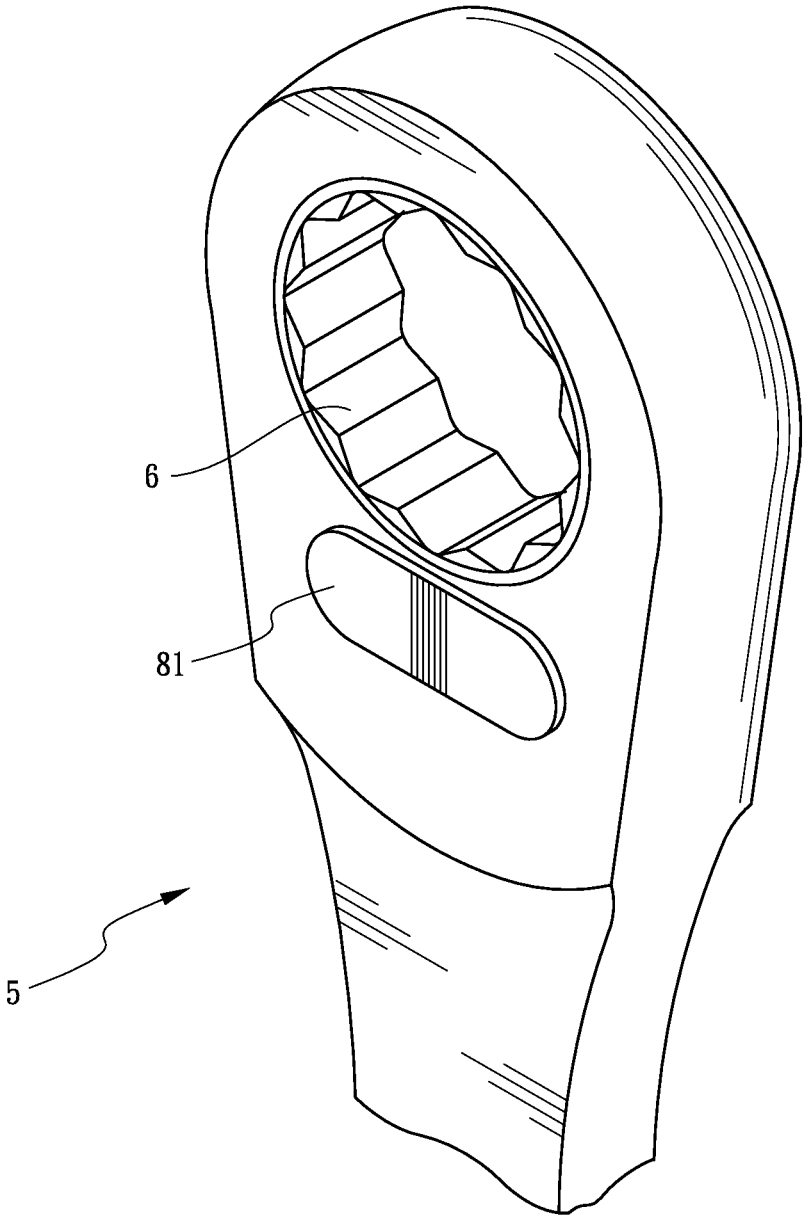
FIG. 8 is an assembled view of the second embodiment.

Referring to FIG. 6, when the switching member 31 is counterclockwise rotated, the positioning member 32 is moved relative to the positioning space 312 and is positioned at the third positioning hole 3123; the pawl set 4 is counterclockwise moved by the motion of the driving block 311 of the switching member 31; as a result, the second pawl 42 is engaged with the ratchet wheel 2 and is abutted against a right inner wall of the receiving space 12, and the first pawl 41 is disengaged from the ratchet wheel 2. Under this arrangement, the ratchet wheel 2 is not counterclockwise rotatable relative to the wrench body 1, but clockwise rotatable relative to the wrench body 1; when the ratchet wheel 2 is clockwise rotated relative to the wrench body 1, the second pawl 42 is moved toward the abutting elastomer 43 by the pushing from the ratchet wheel 2; as a result, the second pawl 42 is disengaged from the ratchet wheel 2 step by step by the a recovery force of the abutting elastomer 43.

Therefore, an operation structure of the present invention is simple and an engaging structure is strengthened.

Furthermore, the driving block 311 has a supporter 313 extended therefrom. The supporter 313 is located at the receiving space 12. The first pawl 41 and the second pawl 42 are both placed on the supporter 313. The switching member 31 has a through hole 33 opened thereon. The switching member 31 is mounted around one end of the ratchet wheel 2 via the through hole 33. The switching member 31 has a step portion 34 defined at an outer side thereof. A surface of the step portion 34 is rough, so that when a user operates the switching member 31 via pressing the step portion 34, a friction between the user's finger and the surface of the step portion 34 is increased.

Referring to FIGS. 7-10, a second embodiment of the present invention is described as following. A ratchet tool device in accordance with the present invention comprises a wrench body 5, a ratchet wheel 6, a pawl set 7, a switching set 8 and a positioning member 9. A receiving hole 51 is opened at a top end of the wrench body 5 therethrough. A receiving space 52 is defined at the top end of the wrench body 5. The receiving space 52 is axially opened from an inner wall of the receiving hole 51 toward a bottom end of the wrench body 5. The receiving space 52 communicates with the receiving hole 51. The receiving space 52 has a first positioning groove 521 and a second positioning groove 522 both defined at a bottom thereof. The ratchet wheel 6 is received in the receiving hole 51. The pawl set 7 has a first pawl 71, a second pawl 72 and an abutting elastomer 73. The first pawl 71 and the second pawl 72 are both received in the receiving space 52. The abutting elastomer 73 is assembled between the first pawl 71 and the second pawl 72. One end of the abutting elastomer 73 abuts against one side of the first pawl 71. Another end of the abutting elastomer 73 abuts against one side of the second pawl 72. The switching set 8 has a switching member 81. The switching member 81 is assembled to the wrench body 5 and seals the receiving space 52. The switching member 81 has a driving block 82. The first pawl 71 and the second pawl 72 in the receiving space 52 are both assembled to the driving block 82, so as to be engaged with the ratchet wheel 6. The driving block 82 has an abutting hole 821 opened at a bottom side thereof, so that the abutting hole 821 selectively corresponds to the first positioning groove 521 or the second positioning groove 522. One end of the positioning member 9 abuts against a bottom of the abutting hole 821. Another end of the positioning member 9 selectively abuts against the first positioning groove 521 or the second positioning groove 522. The first pawl 71 and the second pawl 72 are selectively engaged with or disengaged from the ratchet wheel 6 via operating the switching set 8. The positioning member 9 has a switching elastomer 91 and a bead 92. Two ends of the switching elastomer 91 respectively abut against a bottom of the abutting hole 821 and the bead 92. The bead 92 is movable relative to the receiving space 52, so as to be selectively positioned at one of the first positioning groove 521 and the second positioning groove 522. The receiving space 52 has two top abutting walls 523 and two bottom abutting walls 524. The driving block 82 selectively abuts against one of the two bottom abutting walls 524.

Figure 9:
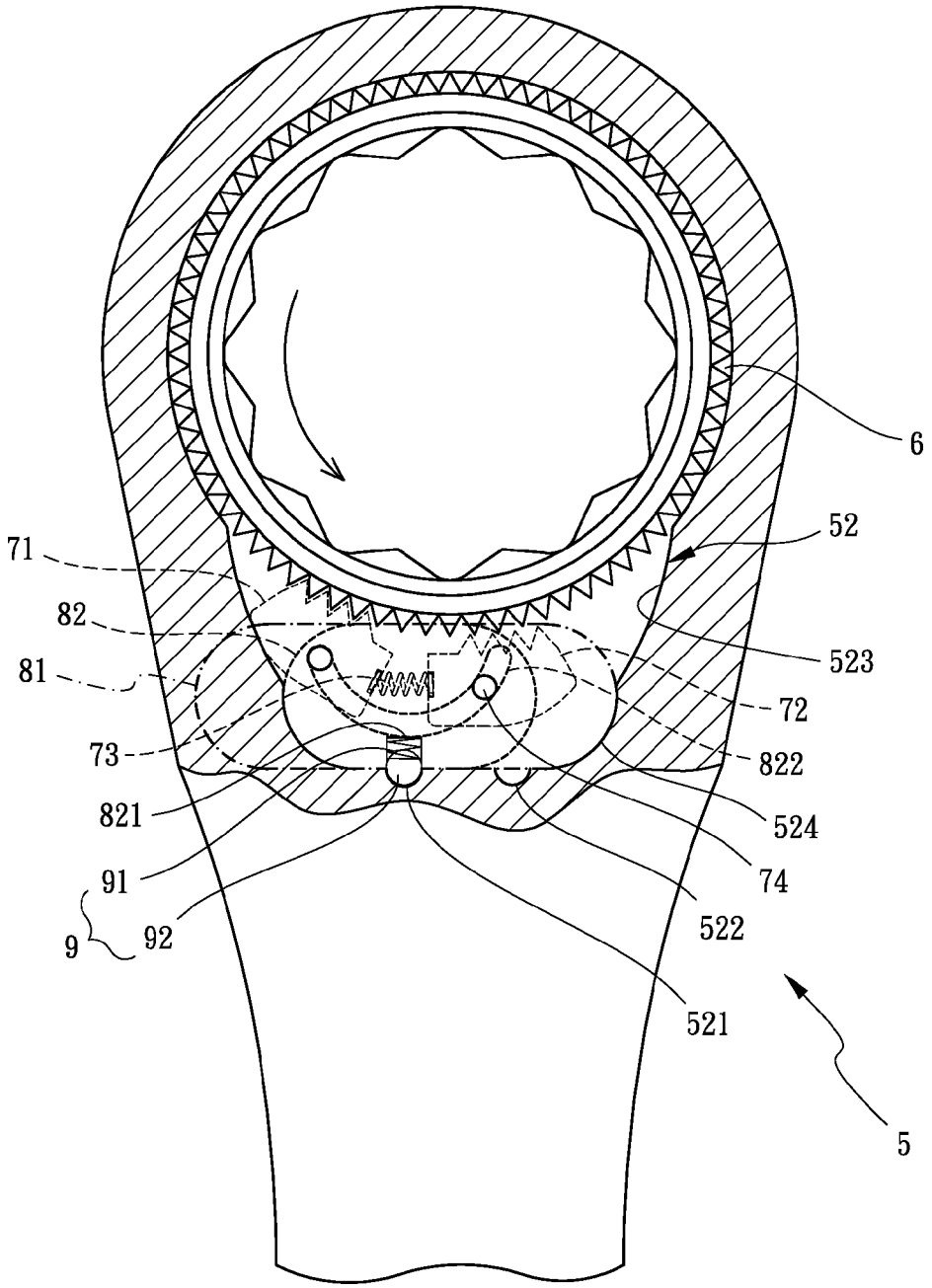
FIGS. 9-10 are side views for showing an operation of the second embodiment.
Figure 10:
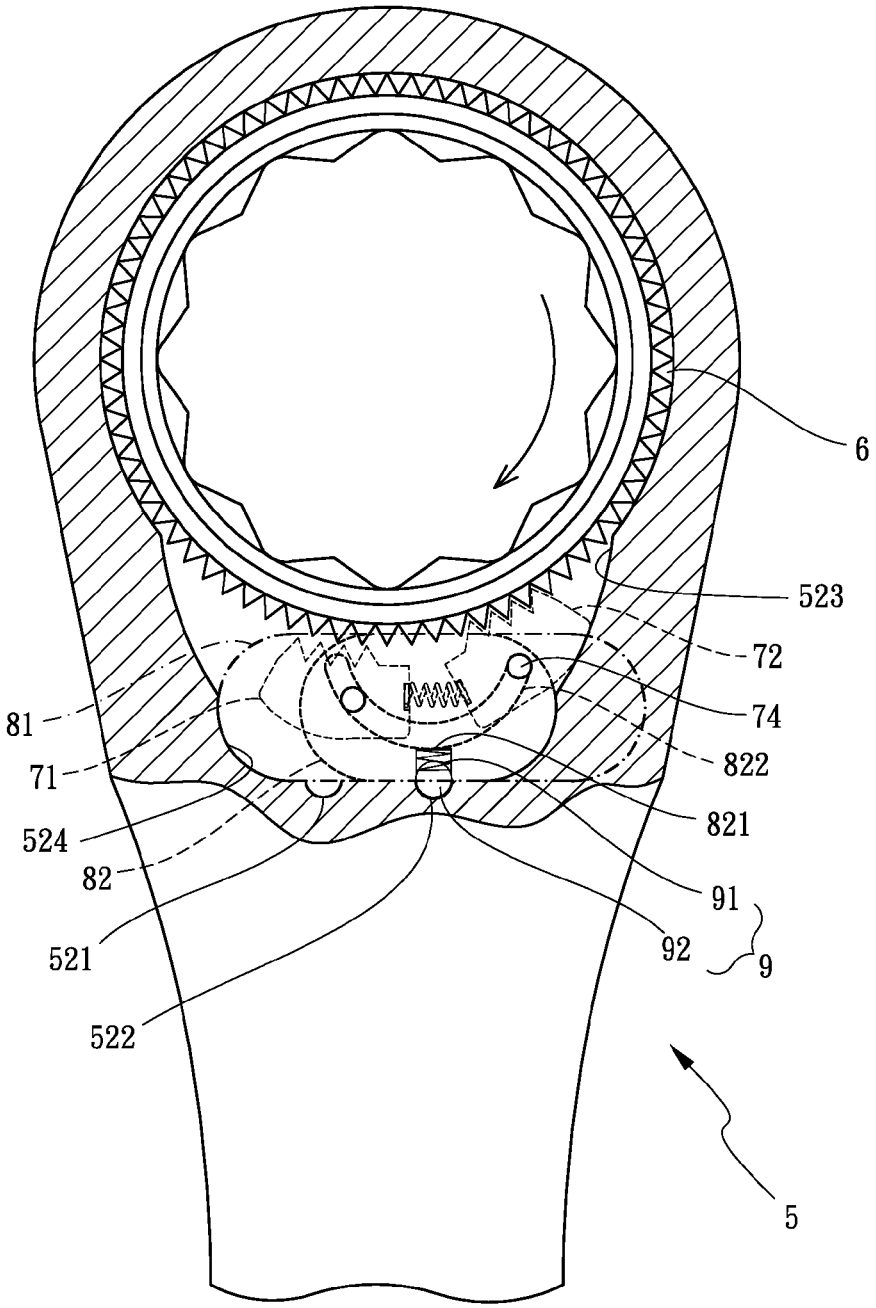

Referring to FIGS. 9-10, when the switching member 81 is left pushed, the first pawl 71 is moved by the motion of the switching member 81 and further abuts against one top abutting wall 523; the first pawl 71 is engaged with the ratchet wheel 6; the bead 92 of the positioning member 9 is moved relative to the receiving space 52 and is positioned at the first positioning groove 521 via a recovery of the switching elastomer 91.

Moreover, the driving block 82 has a sliding groove 822 defined thereon. The sliding groove 822 is curve-shaped, and has a concave side and a convex side. The concave side of the sliding groove 822 faces the receiving hole 51. The convex side of the sliding groove 822 faces the receiving space 52. Each of the first pawl 71 and the second pawl 72 has a rod 74 defined at one side thereof. The rod 74 of each of the first pawl 71 and the second pawl 72 is extended into the sliding groove 822, so that the first pawl 71 and the second pawl 72 are slidable along the sliding groove 822 on the driving block 82.

Referring to FIG. 9, when the switching member 81 is left pushed, the positioning member 9 is moved relative to the receiving space 52 and is positioned at the first positioning groove 521; the pawl set 7 is left moved by the motion of the driving block 82 of the switching member 81; as a result, the first pawl 71 is engaged with the ratchet wheel 6 and is abutted against one top abutting wall 523, and the second pawl 72 is disengaged from the ratchet wheel 6. Under this arrangement, the ratchet wheel 6 is not clockwise rotatable relative to the wrench body 5, but counterclockwise rotatable relative to the wrench body 5; when the ratchet wheel 6 is counterclockwise rotated relative to the wrench body 5, the first pawl 71 is moved toward the abutting elastomer 73 by the pushing from the ratchet wheel 6; as a result, the first pawl 71 is disengaged from the ratchet wheel 6 step by step by a recovery force of the abutting elastomer 73.

Referring to FIG. 10, when the switching member 81 is right pushed, the positioning member 9 is moved relative to the receiving space 52 and is positioned at the second positioning groove 522; the pawl set 7 is right moved by the motion of the driving block 82 of the switching member 81; as a result, the second pawl 72 is engaged with the ratchet wheel 6 and is abutted against another top abutting wall 523, and the first pawl 71 is disengaged from the ratchet wheel 6. Under this arrangement, the ratchet wheel 6 is not counterclockwise rotatable relative to the wrench body 5, but clockwise rotatable relative to the wrench body 5; when the ratchet wheel 6 is clockwise rotated relative to the wrench body 5, the second pawl 72 is moved toward the abutting elastomer 73 by the pushing from the ratchet wheel 6; as a result, the second pawl 72 is disengaged from the ratchet wheel 6 step by step by the recovery force of the abutting elastomer 73.

Although the invention has been explained in relation to its preferred embodiment, it is to be understood that many other possible modifications and variations can be made without departing from the scope of the invention as hereinafter claimed.

What is claimed is:

1. A ratchet tool device comprising:

a wrench body, a receiving hole opened at a top end of the wrench body therethrough, a receiving space defined at the top end of the wrench body, the receiving space axially opened from an inner wall of the receiving hole toward a bottom end of the wrench body, the receiving space communicating with the receiving hole;

a ratchet wheel received in the receiving hole;

a pawl set having a first pawl, a second pawl and an abutting elastomer, the first pawl and the second pawl both received in the receiving space, the abutting elastomer assembled between the first pawl and the second pawl, one end of the abutting elastomer abutting against one side of the first pawl, another end of the abutting elastomer abutting against one side of the second pawl, each of the first pawl and the second pawl having a rod; and a switching set having a switching member and a positioning member, the switching member assembled to the wrench body and sealing the receiving space, the switching member having a driving block and a positioning space, the driving block having a sliding groove defined thereon, the rod of each of the first pawl and the second pawl extending into the sliding groove, the sliding groove forming a close fit along its entire length, so that the first pawl and the second pawl are slidable along the sliding groove on the driving block with the sliding groove providing a stable guide, the driving block having a supporter extended therefrom in the receiving space, the first pawl and the second pawl both being placed on the supporter;

wherein, one end of the positioning member abuts against the wrench body; another end of the positioning member abuts against the positioning space; the positioning member is movable relative to the positioning space, so as to selectively engage the first pawl or the second pawl with the ratchet wheel, or disengage the first pawl or the second pawl from the ratchet wheel.

2. The ratchet tool device as claimed in claim 1, wherein the positioning space has a first positioning hole, a second positioning hole and a third positioning hole which are communicating with each other; the wrench body has an abutting hole; the positioning member has a switching elastomer and a bead; two ends of the switching elastomer respectively abut against a bottom of the abutting hole and the bead; the bead is received into the positioning space; the bead is movable relative to the positioning space, so that the bead is selectively moved to one of the first positioning hole, the second positioning hole and the third positioning hole.

3. The ratchet tool device as claimed in claim 1, wherein the switching member has a through hole opened thereon; the switching member is mounted around one end of the ratchet wheel via the through hole.

4. The ratchet tool device as claimed in claim 1, wherein the switching member has a step portion defined at an outer side thereof; a surface of the step portion is rough.

5. A ratchet tool device comprising:

a wrench body having a receiving hole which is opened at a top end of the wrench body therethrough, a receiving space defined at the top end of the wrench body, the receiving space axially opened from an inner wall of the receiving hole toward a bottom end of the wrench body, the receiving space communicating with the receiving hole, the receiving space having a first positioning groove and a second positioning groove both defined at a bottom thereof;

a ratchet wheel received in the receiving hole;

a pawl set having a first pawl, a second pawl and an abutting elastomer, the first pawl and the second pawl both received in the receiving space, the abutting elastomer assembled between the first pawl and the second pawl, one end of the abutting elastomer abutting against one side of the first pawl, another end of the abutting elastomer abutting against one side of the second pawl, each of the first pawl and the second pawl having a rod defined at one side thereof; a switching set having a switching member, the switching member sealing the receiving space, the switching member having a driving block, the driving block having a sliding groove defined thereon, the sliding groove being curve-shaped and having a concave side and a convex side, the concave side of the sliding groove facing the receiving hole, the convex side of the sliding groove facing the receiving space, the sliding groove having two inner ends, the rod of each of the first pawl and the second pawl extending into the sliding groove, the sliding groove forming a close fit along its entire length, the two respective rods of the first and second pawls respectively contacting the two inner ends of the sliding groove, and being slidable along the sliding groove on the driving block with the sliding groove providing a stable guide, the driving block having an abutting hole opened at a bottom side thereof; and a positioning member having two ends, one end of the positioning member abutting against a bottom of the abutting hole, another end of the positioning member abutting against the first positioning groove or the second positioning groove;

wherein, the switching set is operable, so as to engage the first pawl or the second pawl with the ratchet wheel, or disengage the first pawl or the second pawl from the ratchet wheel.

6. The ratchet tool device as claimed in claim 5, wherein the positioning member has a switching elastomer and a bead; two ends of the switching elastomer respectively abut against a bottom of the abutting hole and the bead; the bead is movable relative to the receiving space, so as to be selectively positioned at one of the first positioning groove and the second positioning groove.

7. The ratchet tool device as claimed in claim 5, wherein the receiving space has two top abutting walls and two bottom abutting walls; the driving block selectively abuts against one of the two bottom abutting walls; the first pawl or the second pawl selectively abuts against one of the two top abutting walls.

* * * * *